United States Patent [19]

Dauser, Jr.

[11] 4,295,004

[45] Oct. 13, 1981

[54] WIRE CONNECTOR

[75] Inventor: William C. Dauser, Jr., North Muskegon, Mich.

[73] Assignee: Lloyd A., Trustee Heneveld, Grand Rapids, Mich.

[21] Appl. No.: 99,624

[22] Filed: Dec. 3, 1979

[51] Int. Cl.[3] ..... H01R 11/00

[52] U.S. Cl. ..... 174/87; 339/98

[58] Field of Search ..... 174/84 S, 87, 88 S; 339/96, 97 R, 98, 99 R

[56] References Cited

U.S. PATENT DOCUMENTS

| | | | |
|---|---|---|---|
| 3,156,762 | 11/1964 | Matthysse | 339/98 X |
| 3,249,908 | 5/1966 | Fuller et al. | 339/98 |
| 4,163,868 | 8/1979 | Stotts | 174/87 |

*Primary Examiner*—Roy N. Envall, Jr.

*Attorney, Agent, or Firm*—Price, Heneveld, Huizenga & Cooper

[57] ABSTRACT

A solderless connector for insulation coated wire conductors includes an elongated nonconductive body member having a plurality of conductor receiving channels formed along its length. A cap member including an annular conductive member is adapted for positioning over the elongated body and the channels. When the cap is pressed on the elongated body with wire conductors positioned in the channels, the annular conductive member engages a portion of the insulation on the conductor, removing the insulation therefrom, engages the wire to provide an electrical connection therewith. The cap is received on a portion of the body to form a tight seal.

17 Claims, 11 Drawing Figures

WIRE CONNECTOR

BACKGROUND OF THE DISCLOSURE

This invention relates to electrical connectors and more particularly solderless electrical connectors such as those used for connecting insulated electrical wiring in commercial and residential electrical applications. The apparatus may also be used for the connection of wires in telephone and other electrical circuits.

In electrical wiring systems, it is necessary to join wires together in the various junction boxes, outlet boxes, utility boxes, switch boxes, lighting fixtures and the like commonly found in wiring systems.

In the past, the insulation was removed from the wire exposing the wire conductor and the joining of the wires was accomplished by soldering the wires together and taping with an insulating electrical tape.

Subsequently, solderless connectors of the type having a threaded metal insert molded into an insulated shell were developed. The connector was screwed on to the ends of the wires to be joined after a portion of the insulation was removed and the wires were twisted together in the connector. Other types of wire connectors included a housing having a removable metal insert, the insert having a set screw which when tightened, engaged the stripped wires. These and other known solderless connectors required that the insulation on the wire conductor be removed or stripped exposing the conductor to the metallic insert so as to obtain a metal-to-metal contact such that the wires were electrically connected. Examples of such previous wire connectors are shown, for example, in U.S. Pat. Nos. 2,036,561, issued Apr. 7, 1936 to S. R. Barrett; 2,123,070, issued July 5, 1938 to J. H. Van Viersen; and 2,416,943, issued Mar. 4, 1937 to J. Nicolazzo.

Subsequently, wire connecting devices were proposed which included a conductive cutting element fixed to an insulated threaded element which was received in an insulated body. The body included a cavity to receive insulated wires and a threaded opening to receive the threaded element. The wires and the cutting element were positioned perpendicular with respect to each other such that when the threaded element containing the cutter engaged and cut through the insulation and into the wires, electrical contact was made. A connector of this type of insulation cutter is shown, for example, in U.S. Pat. No. 3,487,354, issued Dec. 30, 1969 to Alfred E. Duncan.

Another type of insulation cutting apparatus is shown in U.S. Pat. No. 3,579,172, issued May 18, 1971 to Marvin A. Clark. In the Clark patent, a nonconductive body member is threaded and adapted to receive at least a pair of insulated wires. A conductive threaded member having a relatively deep and sharpened V-shaped threaded portion, cuts through the insulation and cuts slightly into the wire as the threaded member is turned into the body.

It will be noted, however, that in each of the abovementioned solderless conductors, it is required that either the wire be stripped, that is, the insulation removed before a connection is made, or that the insulation is cut when the connector is operated to make the connection as the cutter is engaged or the threaded portion cuts through the insulation. Insulation cutting only is achieved and in no case is an actual stripping operation performed on the insulative sheath around the wire conductor to expose a surface of the wire. Thus, only limited point contact is made between the conductive member and the wire.

SUMMARY OF THE INVENTION

The present invention improves upon the prior art in its provision of an insulation stripping solderless connector which both removes a portion of the insulation and provides a large contact area with the wire to provide a superior electrical connection. The connector includes an elongated body of nonconductive material having a plurality of conductor receiving channels formed along its length. At one end of the body, the channels are tapered slightly inwardly toward the center of the body and are provided with serrated portions to engage the insulation and hold the conductor in position. An annular skirt surrounds the elongated body and has an annular receiving channel formed therein adjacent the body. An annular ring-like conductive element is adapted for positioning over the elongated body at the tapered end and is slidable along the body toward the skirt. The conductive element is adapted to engage, cut and strip the insulation on a conductor positioned in the wire receiving channels while it is moved along the body and engages the exposed wire conductors to electrically connect them together. The ring-like conductive element is carried by a nonconductive cap member which includes surfaces which mate with corresponding surfaces on the skirt such that when the cap and skirt are pressed together on the elongated body, a sealing relationship exists which encapsulates the conductive member and the wires positioned therein.

BRIEF DESCRIPTION OF THE DRAWINGS

The invention as well as the many important features thereof will become readily understood with reference to the following specification and accompanying drawings in which.

DESCRIPTION OF THE PREFERRED EMBODIMENT

Figure 1:
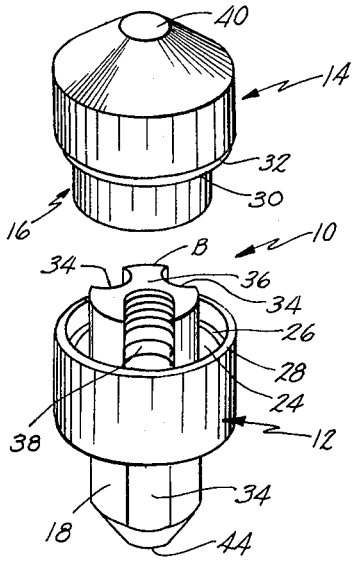
FIG. 1 is an exploded perspective view of the insulation stripping solderless connector of the invention.
Figure 6:
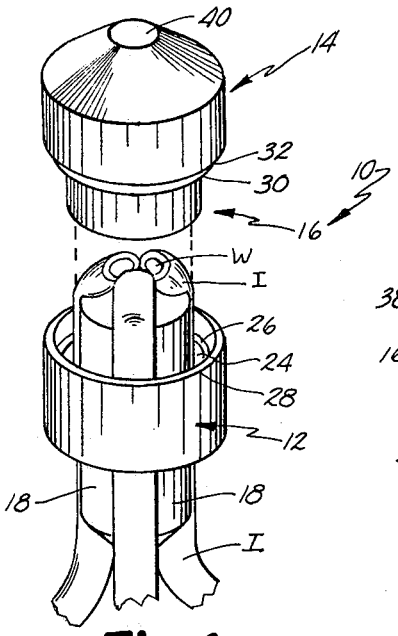
FIG. 6 is an exploded perspective view of the insulation stripping solderless connection of the invention having a wire conductor inserted therein.
Figure 2:
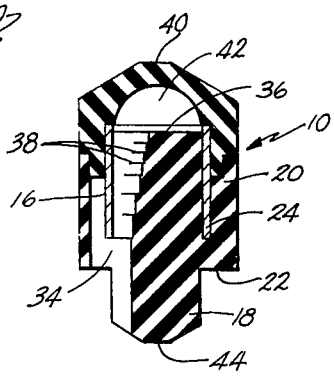
FIG. 2 is a cross-sectional view of the connector of FIG. 1 shown in an assembled condition.

Referring to the drawings, a preferred embodiment of the invention is illustrated in detail. Basically, the wire connector of the invention designated generally by the numeral 10 comprises three component parts, an elongated nonconductive body member 12 adapted to receive a plurality of insulated wires, a cap member 14 and a conductive insulation stripping wire engaging ring-like member 16, With reference to FIGS. 1 and 2, body portion 12 and cap member 14 are preferably molded or otherwise formed from nonconductive material such as plastic, molded nylon or the like as for example glass-filled polyester, ABS, rigid PVC, polycarbonates and modified polyphenylene oxides. Body member 12 is molded to include an elongated center column 18 integrally formed with an annular surrounding skirt 20. Skirt 20 surrounding the column is connected thereto at a base portion 22 (FIG. 2) to thus form an annular well or recess 24 which as will be hereinafter described, receives the leading edge of the conductive stripping ring 16. At the upper extremity of the skirt, a pair of step-like flanges 26 and 28 are formed therein of increasing diameter to mate with corresponding annular step-like flanges 30 and 32, respectively, formed on the lower portion of cap member 14. The flanges or steps insure a fluid-tight seal when the connector parts are pressed together.

A plurality of conductor receiving channels 34 are molded along the length of center column 18. The conductor receiving channels or slots begin at the lower portion of the column, extend through base 22 of skirt 20 to the top of the body member. The slots are generally annular in configuration and in a preferred embodiment are equal to approximately one-half the diameter of a circle such that when an insulated conductor I (FIG. 4A) is positioned therein, the center of the conductor, i.e., the wire W is positioned approximately at the center of the recess 24 so as to be generally in line with the conductive ring 16 as will be hereinafter described. The channels 34 extend upwardly along the length of column 18 and through base 22 of skirt 20 where the channels begin to taper inwardly toward the top of the column. Notches or serrations 38 are formed in the upwardly inwardly tapered portion of channels 34 at the upper end of the column to engage the insulation on the conductor and to prevent the conductor from sliding out of the channel when the actual connection is made. The serrations also serve to eliminate the possibility of the conductor pulling out of the connector once a connection is made. Although three equally spaced channels are shown in the illustrated embodiment, it will be understood that any number of wire channels may be provided depending upon the number of wires to be connected.

Cap member 14 is also annular in configuration and includes the previously described annular flanges 30 and 32 formed along its lower extremity. The cap includes a frustoconical upper surface terminating in a flat portion 40. The inner portion of the cap is formed such that a recess 42 is provided between the inner top portion of the cap and top 36 of center column 18 when cap flanges 30 and 32 are in mating engagement with flanges 26 and 28 of skirt 20. It will also be noted that the lower end of center column 18 also terminates in a frusto-conical configuration to provide a corresponding flat surface 44.

Insulation stripping ring 16 is an elongated annular member formed of conductive material as, for example, half hard brass, phosphor bronze, beryllium copper or the like. The outer diameter of ring 16 is press fitted into cap member 14 and is positioned so as to extend outwardly from the lower part of cap 14 and into recess 24 between center column 18 and skirt 20 when assembled. Ring 16 may be press fit into the central portion of cap 14 or alternately may be fixed to the cap during the molding operation. The inner diameter of ring 16 is such that it snugly fits about the outer diameter of central column 18. The upper end of column 18 is slightly tapered and has a somewhat reduced diameter toward the top portion 36 to receive the inner diameter of ring 16. The inner and outer diameters of the walls forming the annular well or recess 24 correspond closely to the inner and outer diameters of ring 16 to insure a close fit.

OPERATION

Figure 3:
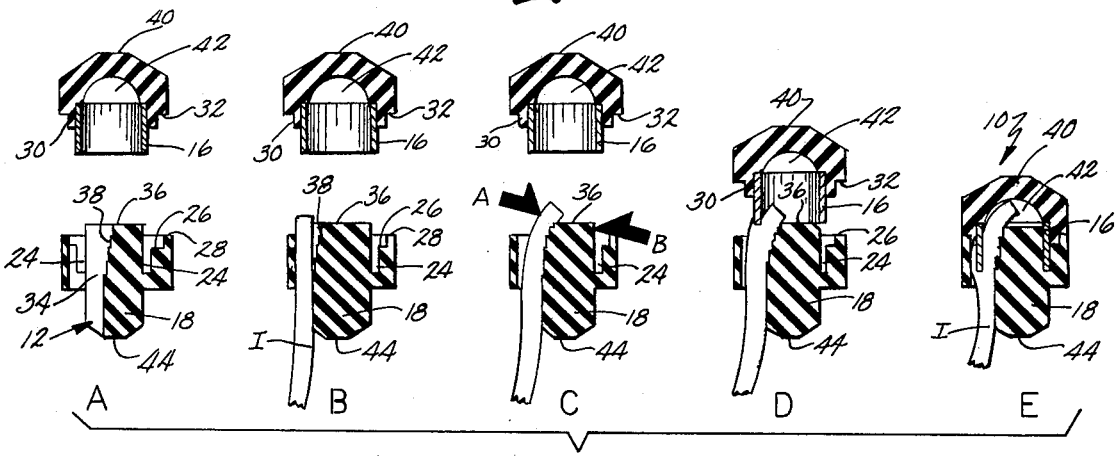
FIGS. 3A–3E are a series of cross-sectional views illustrating the progression of steps involved in making a connection.
Figure 4:
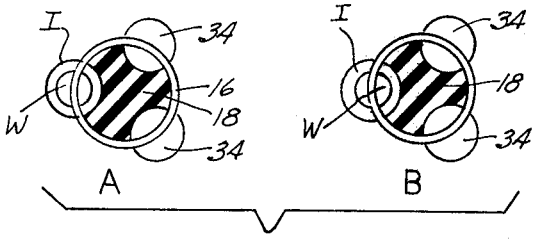
FIGS. 4A and 4B illustrate further the stripping action of the components of the connector.
Figure 5:
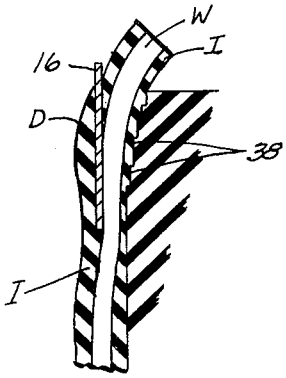
FIG. 5 is an enlarged view showing the contact between the stripping element and the wire conductor.

Referring now to FIGS. 3–5, the actual operation of the invention will be described in detail. The connector 10 including the base 12 and cap 14 with the ring 16 fixed therein are shown in FIG. 3A. Two or more insulated conductors I are positioned through the skirt such that the conductors lay in the wire receiving channels 34 along the length of column 18. The conductor is positioned to extend slightly above top 36 of center column 18 as illustrated in FIG. 3B. The conductors (see FIG. 3C) are bent slightly inwardly toward the center of the column. This may be accomplished by finger pressure or depending upon the wire size, by exerting a slight pressure with the jaws of a pair of pliers, one jaw on the insulated conductor at the channel 34 and the other at the opposite side of the column as illustrated at points A and B of FIG. 3C. The several conductors I, one through each channel, are similarly inserted and bent slightly inwardly toward the center of the column.

Referring to FIG. 3D, cap 14 is positioned over the top of the column with the metal conductive ring 16 engaging and cutting into the insulation as shown at D. As the ring cuts through the wire, it peels the insulation away (see also FIG. 4B) and starts to engage the sidewall surface of the wire W. The jaws of a pair of pliers (not shown) are then positioned at top 40 of cap 14 and bottom 44 of column 18 and pressure is exerted to close the connector. As the connector is closed, ring 16 continues to wipe the insulation from the wire and the ring moves into the recess 24 until the connector and wire is completely closed as illustrated in FIG. 3E and FIG. 5. As illustrated in FIGS. 3E and 5, a substantial portion of the inner wall of ring 16 is in contact with the wire, and the insulation peeled away from the wire has moved into the opening formed through the skirt. The insulation on the wire facing the central column is somewhat compressed into serrations 38 of wire receiving channels 34. The insulation on the outside of the wire peeled by ring 16 is displaced outwardly to the outside diameter of the ring and toward the outer wall of recess 24. Some of the insulation flows downwardly and completely fills the wire receiving openings through skirt 24. Since the openings through the skirt are filled, a completely tight seal results such that moisture and other contaminates cannot enter into contact with the wire connection. Because of the pressure exerted and the superior wiping contact between the wire and the conductive ring, the wire is wiped completely clean and the degree of contact approaches that of molecular contact.

In a preferred embodiment, the connector will accept four wire ranges, from 12 to 18 guage, either solid or stranded wire. The area of contact between the ring and wire is preferably equal to approximately $3\frac{1}{2}$ times the cross-sectional area of a 12 guage wire, although this can be varied depending upon the particular requirements to be met.

It will be appreciated that any number of wire receiving channels may be provided depending upon the particular application. It is also possible to include channels of differing diameters for use in specialized applications where extremely large and extremely small diameters must be connected.

Those skilled in the art will readily appreciate that since it is not necessary to remove the insulation from the wire prior to making the connection, assembly time is much less than that required when using known connectors. The simple connector lends itself well to comparatively inexpensive injection molding techniques and in operation, a superior connection is provided. Since when the connection is made, the ring is moved along the length of the wire conductor, the possibility of cutting into the wire itself is eliminated. The connection, therefore, is readily usable with both solid and stranded wires. It will additionally be readily recognized that the base member and the cap member cooperate in a novel manner with the conductive element to provide a means for making rapid, reliable electrical connections with a minimum of effort. Since the cap and base are of molded construction and the condutive element does not require special treatment, the cost is significantly reduced from prior art connector devices. While the terms "ring-like" and "annular" have been used to describe various components of the connector, the terms are not intended to be used in a limiting sense, but rather are used to describe an object which is at least partially encompassing rather than completely encircling. It will be appreciated by those skilled in the art that different embodiments may be conceived and fabricated without departing from the scope of the invention as set forth in the appended claims.

The embodiments of the invention in which an exclusive property or privilege is claimed are defined as follows.

1. A self-stripping solderless electrical connector comprising:

an elongated body of insulating material having wire receiving channels formed along at least a portion of its length;

a cap member having a conductive member fixed thereto, said cap member and said conductive member being adapted for positioning over and movable along a portion of said elongated body and said channels, said conductive member adapted to engage a plurality of insulated wire conductors positioned in said channels, cut through the insulation thereof, and engage wire conductors to provide an electrical connection therebetween upon movement of said cap member and conductive member along said elongated body.

2. The solderless connector as described in claim 1 wherein said cap member is formed of insulating material and said conductive member is fixed within said cap member.

3. The solderless connector of claim 1 or 2 and further including a skirt surrounding said body member, said skirt and said cap member having mating interfitting surfaces formed thereon whereby to create a weatherproof seal therebetween.

4. The connector of claim 2 wherein said body member has three wire receiving channels formed therein.

5. The connector of claim 1, 2, or 4 wherein said body member includes an elongated first portion, said channels formed in said elongated first portion being tapered inwardly toward the upper extremity of said first portion, said tapered portion having serrations formed therein to engage the insulation of and hold an insulated conductor positioned therein.

6. A solderless self-stripping electrical connector comprising:

a body portion, said body portion being elongated and having a plurality of channels formed along the exterior length thereof, said channels being adapted to receive insulated wire conductors;

a skirt member integrally formed around said body portion, said channels passing through said skirt portion;

a cap member adapted to cover one end of said elongated member and said wire receiving channels and engage said skirt portion;

a conductive member fixed in said cap member, said conductive member adapted to partially remove insulation from and physically contact wires positioned within said channels, said conductive member surrounding said body portion and said channels and being received in said skirt member when said cap is pressed along a portion of said body portion toward said skirt.

7. The connector of claim 6 wherein said cap member has a cavity formed therein to accomodate ends of conductors placed in said channels.

8. The connector of claim 7 wherein the upper extremity of said cap member and the lower extremity of said body portion have means thereon adapted for engagement by the jaws of a pair of pliers whereby said body and said cap can be pressed together.

9. The connector of claim 8 wherein when said cap member is pressed into engagement with said skirt, said conductive member peels the insulation from a conductor placed therein, said skirt member having a recess formed therein to receive said insulation material, said insulation material in said recess forming a weathertight seal.

10. The connector of claim 9 wherein said conductive member is formed of half hard brass.

11. A solderless connector for insulation covered conductors comprising:

an elongated body of nonconductive material having a plurality of conductor receiving channels formed along its length, said channels at one end of said body being tapered inwardly toward the center of said body and being provided with serrated portions along said tapered portions to engage the insulation on a conductor;

an annular skirt surrounding said elongated body, said skirt having an annular receiving channel formed therein adjacent said body;

a conductive element adapted for positioning over said elongated body and slidable along the length of said body toward said skirt, said conductive element being adapted to engage insulation on an insulated conductor positioned in said receiving channels and to remove the insulation therefrom while moving along and engaging the conductor to thereby electrically connect a conductor positioned in said channels.

12. The connector of claim 11 wherein said connector includes a nonconductive cap member fixed to said conductive element for movement therewith, said cap member and said skirt each having mating surfaces formed thereon whereby said cap and said skirt can be placed in a sealing relationship encapsulating said conductive element therebetween.

13. A solderless connector for insulation covered conductors comprising:

an elongated body having a central portion surrounded by a skirt;

elongated channels extending longitudinally of said body located radially inwardly of said skirt, and formed between said skirt and said central portion, said channels being adapted to receive insulated wire conductors;

a cap member having a closed end and an open end, said open end receiving an elongated conductor member formed of a thin wall of conductive material and having a longitudinal opening extending along a length thereof for receiving said central portion of said body, said conductor member being shaped to be receivable between said skirt and said central portion whereby when forced over said central portion it engages the insulated wire conductors positioned in said channels and strips portions of the insulation thereof to provide an electrical contact therewith.

14. The solderless connector of claim 13 in which the cap member at its open end has surfaces which mate and interfit with surfaces of said body to create a seal therebetween.

15. The connector of claim 14 wherein the closed end of said cap member forms a cavity to receive ends of conductors placed in said channels.

16. The connector of claim 15 wherein the upper extremity of said cap member and the lower extremity of said body portion have means thereon adapted for engagement by the jaws of a pair of pliers whereby said body and said cap can be pressed together.

17. The connector of claim 16 wherein when said cap member is pressed into engagement with said skirt, said conductor member peels the insulation from a conductor placed therein, said skirt member having a recess formed therein to receive said insulation material, said insulation material in said recess forming a weathertight seal.

* * * * *

UNITED STATES PATENT AND TRADEMARK OFFICE

CERTIFICATE OF CORRECTION

PATENT NO. : 4,295,004

DATED : October 13, 1981

INVENTOR(S) : William C. Dauser, Jr.

It is certified that error appears in the above—identified patent and that said Letters Patent is hereby corrected as shown below:

On the title page:

Assignee: Should read --Lloyd A. Heneveld, Trustee, Dauser Trust IV - SOLDERLESS CONNECTOR, Grand Rapids, Michigan Column 4, line 57;
"guage" should be -- gauge --;

Column 4, line 60;
"guage" should be -- gauge --;

Column 5, line 24;
"encirciling" should be -- encircling --;

Column 6, Claim 7, line 20;
"accomodate" should be -- accommodate --.

Signed and Sealed this

Sixth Day of March 1984

[SEAL]

Attest:

GERALD J. MOSSINGHOFF

Attesting Officer

Commissioner of Patents and Trademarks

REEXAMINATION CERTIFICATE (71st)

United States Patent [19]

Dauser, Jr.

[11] B1 4,295,004

[45] Certificate Issued Apr. 12, 1983

[54] WIRE CONNECTOR

[75] Inventor: William C. Dauser, Jr., North Muskegon, Mich.

[73] Assignee: Lloyd A. Heneveld, trustee, Grand Rapids, Mich.

Reexamination Request

No. 90/000,133, Dec. 28, 1981

Reexamination Certificate for:

Patent No.: 4,295,004
Issued: Oct. 13, 1981
Appl. No.: 99,624
Filed: Dec. 3, 1979

[51] Int. Cl.[3] ..... H01R 11/00
[52] U.S. Cl. ..... 174/87; 339/98
[58] Field of Search ... 174/84 S, 87, 88 S; 339/96, 97 R, 98, 99 R

[56] References Cited

U.S. PATENT DOCUMENTS

| | | | |
|---|---|---|---|
| 3,040,150 | 6/1962 | Rueger. | |
| 3,221,096 | 11/1965 | Croghan | 174/88 R |
| 3,492,629 | 1/1970 | Hirsch. | |
| 3,668,301 | 6/1972 | Faulconer | 174/88 R |
| 3,906,148 | 9/1975 | Wittes. | |

FOREIGN PATENT DOCUMENTS

| | | |
|---|---|---|
| 45070 | 1/1939 | Netherlands. |
| 636721 | 1/1977 | U.S.S.R. |

*Primary Examiner*—Roy N. Envall, Jr.

[57] ABSTRACT

A solderless connector for insulation coated wire conductors includes an elongated nonconductive body member having a plurality of conductor receiving channels formed along its length. A cap member including an annular conductive member is adapted for positioning over the elongated body and the channels. When the cap is pressed on the elongated body with wire conductors positioned in the channels, the annular conductive member engages a portion of the insulation on the conductor, removing the insulation therefrom, engages the wire to provide an electrical connection therewith. The cap is received on a portion of the body to form a tight seal.

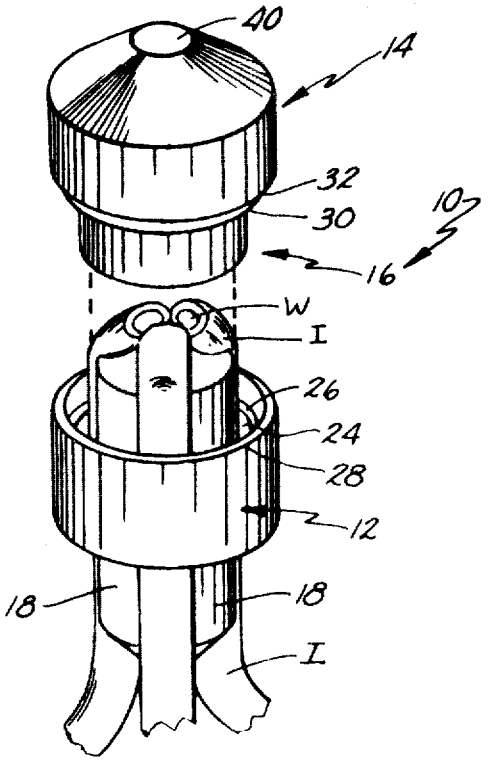

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6–17 is confirmed.

Claims 1, 4 and 5 are determined to be patentable as amended.

Claims 2 and 3, dependent on amended claims, are determined to be patentable.

1. A self-stripping solderless electrical connector comprising:

an elongated body of insulating material *having a surface extending along an axis of said body and* having wire *conductor* receiving channels formed along at least a portion of [its] *the* length *of said surface, extending in the same general direction of said axis, and located at spaced intervals around said axis;* a cap member *of insulating material* having a conductive member fixed thereto, said cap member and said conductive member being adapted for positioning over and *snugly interfitting with said elongated body upon being linearly* movable *in a linear direction* along *said axis and along* a portion of said elongated body and said channels; said conductive member [adapted] *having a cutting edge; said channels being tapered inwardly toward said axis whereby by means of the snug interfit of said conductive member with said body, upon said movement of said cap member and conductive member in said linear direction along said portion of said elongated body said cutting edge is guided along the channels* to engage a plurality of insulated wire conductors positioned in said channels, cut through the insulation thereof *in a direction lengthwise of said conductors,* and [engage] *make electrical contact with the wires of said* wire conductors to provide an electrical connection *between said wires* [therebetween upon movement of said cap member and conductive member along said elongated body].

4. The connector of claim *1*, 2 *or 3* wherein said body member has three wire receiving channels formed therein.

5. The connector of claim 1, 2 [,] *or* 3 [or 4] wherein said body member includes an elongated first portion, said channels formed in said elongated first portion being tapered inwardly toward the upper extremity of said first portion, said tapered portion having serrations formed therein to engage the insulation of and hold an insulated conductor positioned therein.

* * * * *